US006938544B2

(12) United States Patent
Bäcker et al.

(10) Patent No.: US 6,938,544 B2
(45) Date of Patent: Sep. 6, 2005

(54) BELT DRIVE

(75) Inventors: Dieter Bäcker, Sandhausen (DE); Roland Hirth, Römerberg (DE); Richard Mack, Kennesaw, GA (US); Ralf Weiser, Ladenburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 13 days.

(21) Appl. No.: 09/780,307

(22) Filed: Feb. 9, 2001

(65) Prior Publication Data

US 2001/0014243 A1 Aug. 16, 2001

(30) Foreign Application Priority Data

Feb. 9, 2000 (DE) ..... 100 05 633

(51) Int. Cl.[7] ..... F16H 55/56

(52) U.S. Cl. ..... 101/232; 101/216; 474/8; 474/139; 474/140; 474/242

(58) Field of Search ..... 101/232, 416.1, 101/417, 420, 424.2, 216; 474/13, 242, 247, 237, 238, 8, 118, 139, 140

(56) References Cited

U.S. PATENT DOCUMENTS

| | | | | | |
|---|---|---|---|---|---|
| 3,954,261 | A | * | 5/1976 | Greene et al. | 101/232 |
| 4,144,772 | A | * | 3/1979 | Brackin et al. | 474/135 |
| 4,392,840 | A | * | 7/1983 | Radocaj | 474/117 |
| 4,500,303 | A | * | 2/1985 | Sermersheim et al. | 474/112 |
| 4,631,042 | A | * | 12/1986 | Rattunde | 474/8 |
| 4,915,677 | A | * | 4/1990 | Simon | 474/242 |
| 5,077,922 | A | * | 1/1992 | Miller | 40/472 |
| 6,176,796 | B1 | * | 1/2001 | Lislegard | 474/93 |
| 6,186,915 | B1 | * | 2/2001 | Dietl | 474/8 |
| 6,219,608 | B1 | * | 4/2001 | Abo et al. | 701/51 |
| 6,250,224 | B1 | * | 6/2001 | Hofmann et al. | 101/416.1 |
| 6,358,609 | B2 | * | 3/2002 | Kinoshita et al. | 428/375 |
| 6,371,015 | B1 | * | 4/2002 | Tomiya | 101/128.4 |
| 6,379,275 | B1 | * | 4/2002 | Serkh | 474/49 |
| 6,398,679 | B1 | * | 6/2002 | Brown | 474/35 |
| 6,408,239 | B2 | * | 6/2002 | Bacher et al. | 701/67 |
| 6,440,023 | B2 | * | 8/2002 | Kanehara et al. | 474/242 |

FOREIGN PATENT DOCUMENTS

| | | |
|---|---|---|
| DE | 29 28 403 A1 | 1/1980 |
| EP | 0 458 260 A2 | 11/1991 |
| JP | 04-133928 A | 5/1992 |

OTHER PUBLICATIONS

Darrel Johnson: "Guiding and Controlling Conveyor Belts", Automation, Dec. 1972, pp. 56–59.

W. Müller: "Über den Geradelauf des Förderbandes", [about the straight running of a conveyor belt], Continental Transportband–Dienst, No. 4, pp. 1–8.

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Ralph E. Locher

(57) ABSTRACT

A belt drive for a machine for printing images on a flat printing material, having a continuous belt revolving during operation, includes a belt guide having stops for two protruding edges of the belt, the edges being oriented in a longitudinal direction of the belt and opposite one another in a transverse direction of the belt; and a machine for printing images on flat printing material having such a belt drive.

3 Claims, 3 Drawing Sheets

BELT DRIVE

BACKGROUND OF THE INVENTION

Field of the Invention

The invention relates to a belt drive for a machine for printing images on flat printing materials, the belt drive having a continuously revolving belt and a belt guide, and to a machine for printing images on flat printing material, which is equipped with the belt drive.

In machines of this type, belt drives fulfill a variety of tasks. They are used both for driving the machines and for transporting the printing material, for example, in a feeding table of a sheet processing rotary printing machine, as well as for braking and discharging the printing material, for example, in a delivery of a corresponding rotary printing machine.

To prevent the belt from slipping out of the rollers or belt pulleys which it surrounds, belt guides are provided, which utilize different principles of guidance. According to a first principle, flanged-coupling pulleys are provided at the side of the rollers or belt pulleys surrounded by the belt. The flanged-coupling pulleys form annular or ring surfaces which are disposed perpendicularly to the axes of rotation of the rollers or belt pulleys, the annular surfaces being situated directly opposite each lateral surface of the belt, thereby preventing a lateral displacement thereof. This principle is suitable for a wide variety of belts; however, slippage is caused at the belt due to the frictional contact of the lateral surfaces thereof with the annular surfaces of the flanged-coupling pulleys.

In accordance with another principle, belt drives which serve particularly for transport purposes are equipped with rollers, the cylindrical surfaces of which are surrounded by a belt, are formed convexly, i.e., with respective crowns, thereby effectuating an automatic centering of the corresponding belt in a conventional manner.

Tests conducted by applicant have demonstrated, however, that this principle is not applicable to belts which do not have a constant modulus of elasticity along the width thereof.

SUMMARY OF THE INVENTION

It is accordingly an object of the invention to provide a belt drive having a continuous revolving belt and a belt guide for a machine for printing images on a flat printing material, wherein the belt revolves in proper alignment with optimally little slippage, regardless of the construction thereof.

With the foregoing and other objects in view, there is provided, in accordance with the invention, a belt drive for a machine for printing images on a flat printing material, having a continuous belt revolving during operation, comprising a belt guide having stops for two protruding edges of the belt, the edges being oriented in a longitudinal direction of the belt and opposite one another in a transverse direction of the belt.

In accordance with another feature of the invention, the stops remain stationary with respect to the belt revolving during operation.

In accordance with a further feature of the invention, the belt drive includes rotationally symmetrical stop surfaces formed on the stops, the stop surfaces being in rolling contact with the edges.

In accordance with a concomitant aspect of the invention, there is provided a machine for printing images on flat printing material, having a belt drive with a continuous belt revolving during operation, comprising a belt guide having stops for two protruding edges of the belt, the edges being oriented in a longitudinal direction of the belt and opposite to one another in a transverse direction of the belt.

To achieve the objective of the invention, the belt guide is formed by stops for two protruding edges of the belt, which are oriented in a longitudinal direction of the belt and which are situated opposite one another in a transverse direction of the belt.

This type of belt guide is also particularly suitable for belts having a cross section, for example, which deviates from that of a flat band to the extent that a gearing is provided only in the region of a respective edge of the belt, and the gearing is constructed from a different material than a belt that connects the gearings.

In a first development, provision is made for the stops to remain stationary in relation to the revolving belt. In this development, the stops are arranged at a suction chamber which is stroked or swept by a strand of the belt and which forms, together with the belt, a suction conveyor for the flat printing material which is disposed on the strand for transport or braking purposes.

The stops thus are formed with stop surfaces extending in the longitudinal direction of the strand, which are inclined or curved in the transverse direction of the strand. In the given example, the stops are assigned to protruding edges of the belt, which are situated on the inside relative to the belt, which, in the case of a belt that is provided in the form of a flat belt, represent the inside outer edges thereof. But this assignment of edges of the belt and stops therefor is not mandatory. Rather, the stops can be assigned to each pair of opposing protruding edges of the belt so that the stops acting thereat prevent the belt from deviating laterally in opposing directions.

According to another development, rotationally symmetrical stop surfaces are provided, which are in rolling contact with the edges. In this regard, the mutual assignment of the stop surfaces, on the one hand, and the edges, on the other hand, is accomplished in the same manner as was described for stationary stops.

The following detailed description of the invention with reference to drawings is based on one of the aforementioned fields of application of the belt drive, namely a delivery for a machine which prints images on flat printing material in the form of a sheet processing rotary printing machine.

Other features which are considered as characteristic for the invention are set forth in the appended claims.

Although the invention is illustrated and described herein as embodied in a belt drive, it is nevertheless not intended to be limited to the details shown, since various modifications and structural chances may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
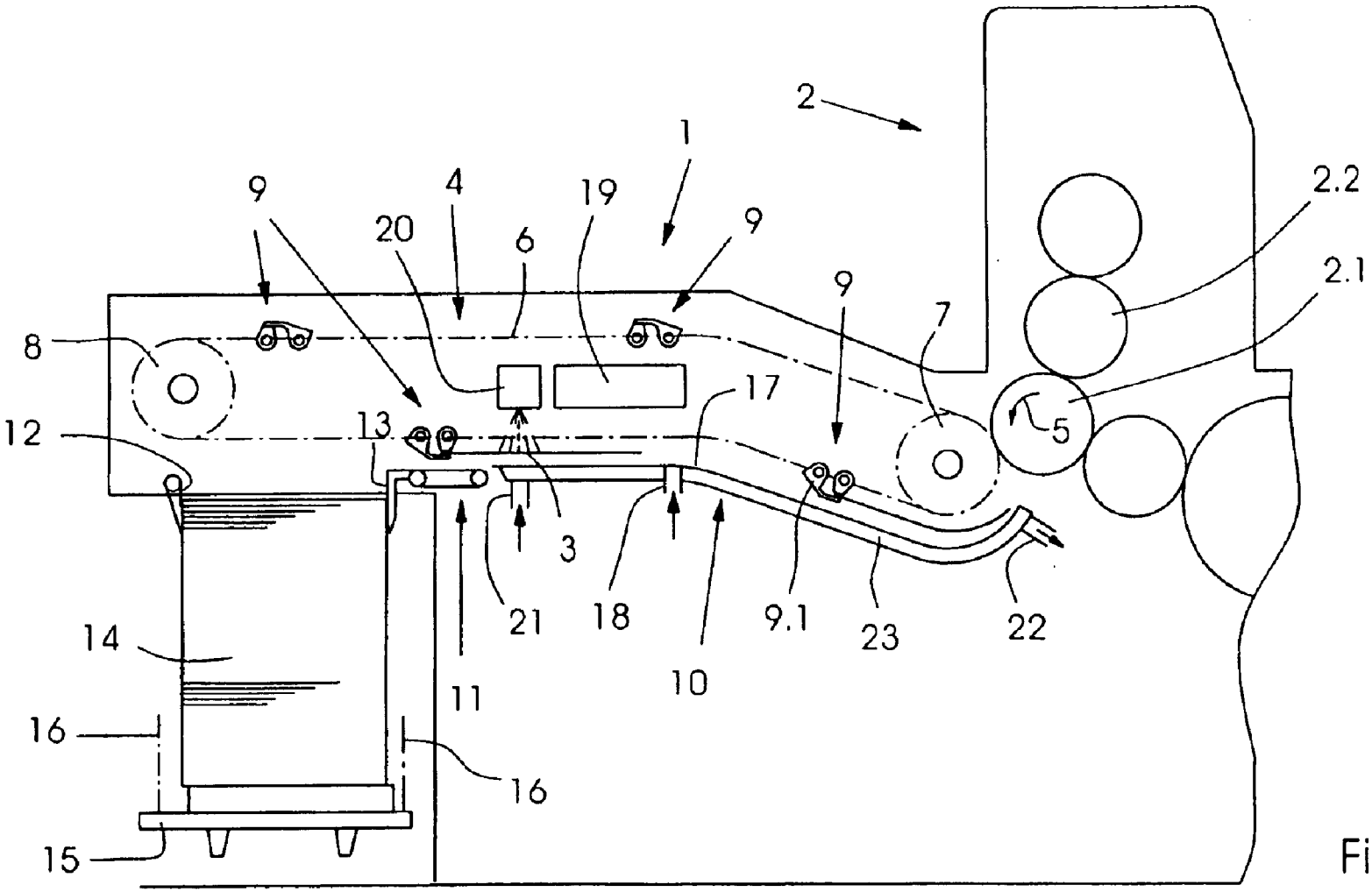
FIG. 1 is a rough diagrammatic fragmentary view of a sheet-processing rotary printing machine which is equipped with belt drives, the illustrated section of the printing machine including a delivery.

Referring now to the drawings and, first, particularly to FIG. 1 thereof, there is shown therein, with regard to one of the aforementioned fields of use of a belt drive, a section of a sheet processing rotary printing machine, which includes a sheet delivery 1 following a final processing station. Such a processing station can be a printing unit or a post-processing unit, such as, a varnishing unit, for example. In the example illustrated in FIG. 1, the final processing station is a printing unit 2 operating by the offset method with an impression cylinder 2.1. The impression cylinder 2.1 guides a respective sheet 3 in a processing direction represented by a direction-of-rotation arrow 5, through a printing nip between the printing cylinder 2.1 and a rubber blanket cylinder 2.2 cooperating therewith, and then transfers the sheet to a chain conveyor 4 upon the opening of grippers which are disposed on the printing cylinder 2.1 and provided for gripping the sheet 3 at a gripper margin thereof located at the leading end of the respective sheet. The chain conveyor 4 includes two conveyor chains 6, respectively, revolving along a respective sidewall of the chain delivery during operation. Each conveyor chain 6 is looped around one of two respective synchronously driven drive sprocket wheels 7 having rotational axes which are aligned with one another and, in the example of FIG. 1, is guided via a respective guide sprocket wheel 8 which is located downline from the drive sprocket wheels 7, as viewed in the processing direction. Gripper systems 9 extending between the two conveyor chains 6 and borne thereby are provided with grippers 9.1 and traverse gaps between the grippers 9.1, which are arranged at the impression cylinder 2.1, and pick up a respective sheet 3 upon gripping the gripper margin at the leading end of the respective sheet 3 immediately prior to the opening of the grippers that are arranged on the impression cylinder 2.1, transport the sheet via a sheet guiding device 10 to a sheet brake 11, and open thereat for transferring the sheet 3 to the sheet brake 11. This introduces to the sheet 3 a reduced deposition speed relative to the processing speed and releases the sheet 3 when the reduced deposition speed is attained, so that a decelerated sheet 3 ultimately comes into contact with the front or leading edge stops 12 and forms a sheet pile 14 together with preceding and/or succeeding sheets 3 upon the alignment thereof at the stops 12, as well as at opposite rear or trailing edge stops 13, the sheet pile 14 being lowerable by a lifting mechanism as the sheet pile 14 grows. FIG. 1 shows only a platform 15 of the lifting mechanism, which bears the sheet pile 14, and lifting chains 16, represented in phantom, which bear the platform 15.

The conveyor chains 6 are led along their paths between the drive sprocket wheels 7, on the one hand, and the guide sprocket wheels 8, on the other hand, by chain guide rails, which thus define the chain paths of the strands of the chain. In the example illustrated in FIG. 1, the sheets 3 are transported by the lower strand of the chain. The portion of the chain path that is traversed thereby is followed adjacent thereto by a sheet guiding surface 17 formed on the sheet guiding device 10 and facing the lower chain strand. Between the sheet guiding surface 17 and the respective sheet 3 that is being transported on thereover, a supporting air blanket is preferably formed during operation. To this end, the sheet guiding device 10 is equipped with blast air jets or nozzles terminating in the sheet guiding surface 17, one of which is shown in FIG. 1 symbolically in the form of a nozzle 18 as representative of all thereof.

In order to prevent the printed sheets 3 from adhering to one another in the sheet pile 14, a drier 19 and a duster 20 are provided on the path of the sheets 3 from the drive sprocket wheels 7 to the sheet brake 11.

To prevent the sheet guiding surface 17 from overheating due to the drier 19, a coolant circuit is integrated into the sheet guiding device 10, which is symbolically indicated in FIG. 1 by an inlet nozzle 21 and an outlet nozzle 22 for a coolant tank 23 that is assigned to the sheet guiding surface 17.

Figure 2:
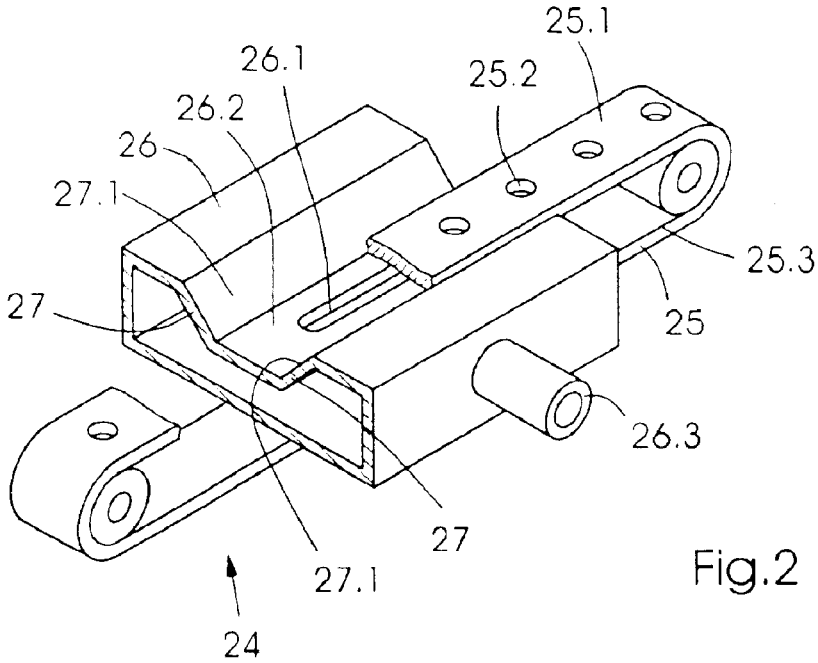
FIG. 2 is a simplified perspective view, partly in section, of a belt guide having stops which remain stationary with respect to a belt which revolves during operation.

The sheet brake 11 includes a plurality of belt drives 24 which are represented in simplified form in FIG. 2, each of the belt drives 24 having a continuous belt 25 revolving during operation and having a brake strand 25.1 which moves in the direction of processing. For calibrating the belt drives 25, they are adjustable to specific formats of the processed sheets by non-illustrated adjusting mechanisms to a respective defined distance from the sheet pile 14 and along also non-illustrated bearing and guiding mechanisms, to desired positions in a transverse direction relative to the direction of processing.

The grippers 9.1 of each gripper system (note FIG. 1) transfer a respective sheet 3 to the respective brake strand 25.1 of the belt drives 24. The belt 25 is formed with openings 25.2. The brake strand 25.1 of the belt 25 is led over a suction table 26, which is connected to a non-illustrated low-pressure generator via a nozzle 26.3 and is formed with at least one suction opening 26.1, which faces the brake strand 25.1.

In a construction of the sheet brake 11 that is provided here by way of example, the respective belt 25 revolves at the speed of the revolving gripper system 9 during the transfer of a respective sheet 3 to the brake strand 25.1. Upon release of a respective sheet 3 by a gripper system 9, the respective belt 25 and with it a sheet 3 that is attached thereto by suction are braked to the deposition speed and are ultimately released by the belt drive 24 for forming the sheet pile, whereupon the belt drive 24 is accelerated back to the speed of the revolving gripper systems 9 again.

The belt drive 24 is equipped with stops 27 which remain stationary relative to the belt 25 that revolves during operation. Each of these stops 27 forms a ramp for an edge 25.3 of the belt 25 that is situated on the inside relative to the belt 25, which is exemplarily represented here in the form of a flat band belt. In the example at hand, the stops 27 are formed at the suction table 26, which has a belt support surface 26.2 that is stroked or swept by the brake strand 25.1 of the belt 25 during operation and, in the transverse direction thereof, is adapted or matched to the width of the belt 25. The aforementioned ramps are disposed laterally at the belt support surface 26.2 relative to the longitudinal direction of the braking strand 25.1, and they rise from the level of the belt support surface 26.2 (in the example of FIG. 2, by somewhat less than the thickness of the belt 25) so that they form stop surfaces 27.1 on both sides of the belt 25, which face towards each other and which are inclined away from the brake strand 25.1, respectively.

In another preferred construction, the stop surfaces 27.1 are not flat surfaces, but rather, are curved concavely relative to a respective side edge of the brake strand 25.1 so that the curvature extends in planes which are perpendicular to the lateral edges.

Figure 3:
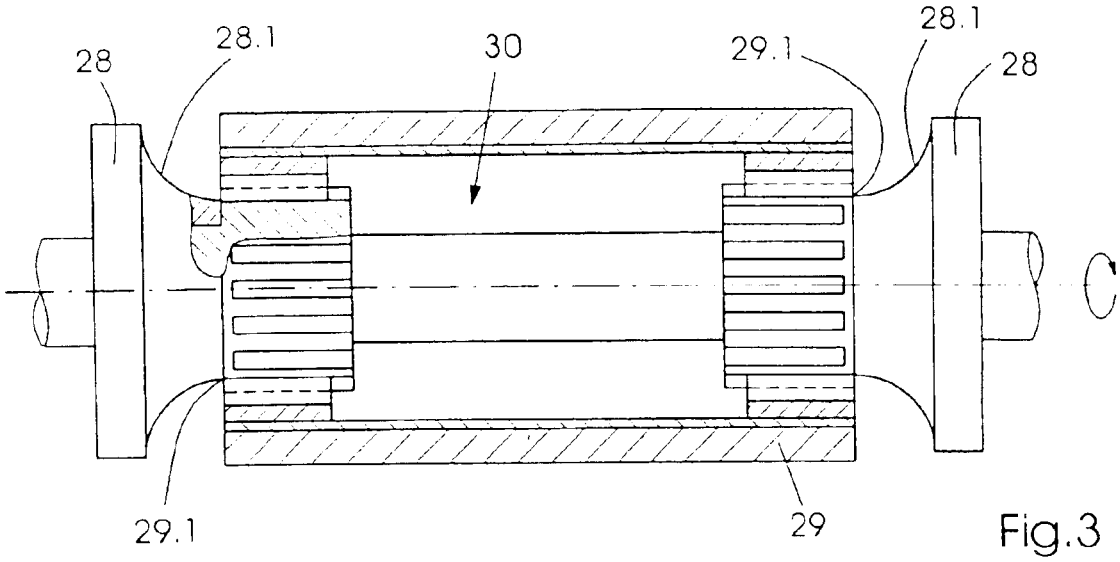
FIG. 3 is a side elevational, partly cut away and partly sectional view of another embodiment of the belt guide using rotationally symmetrical stop surfaces.

FIG. 3 shows a particularly abrasion-free preferred construction wherein stops 28 are formed with rotationally symmetrical stop surfaces 28.1 which are in rolling contact with corresponding edges 29.1 of a belt 29 during operation. Each of the stop surfaces 28.1, in turn, forms a ramp (with a curved rise, in this embodiment) for one of the respective protruding edges 29.1 of the belt 29, which are situated opposite one another, so that the stops 28 acting at these edges 29.1 prevent the belt 29 from deviating laterally in mutually opposing directions.

In a preferred construction, the stops are arranged in the form of wheel flanges, as it were, at a roller 30 that is suitable for driving or guiding the belt 29.

In this way, it is possible to provide perfectly aligned guidance particularly to a belt which, as in the case of the belt 29, has a special construction to the effect that a respective edge region thereof is provided with an inner gearing. This is installed in a ridge which is connected to a belt strap and which, for a specific use of the belt drive 24 (in FIG. 3, that of a sheet brake, in particular), preferably has a significantly larger modulus of elasticity than the belt strap, so that the modulus of elasticity of the belt 29 is not constant over the width thereof.

According to a development represented in FIG. 3, the stop surfaces 28.1 are assigned to the mutually averted edges 29.1 of a respective ridge, which is provided with a gearing. Such an assignment is not mandatory, however.

Figure 4:
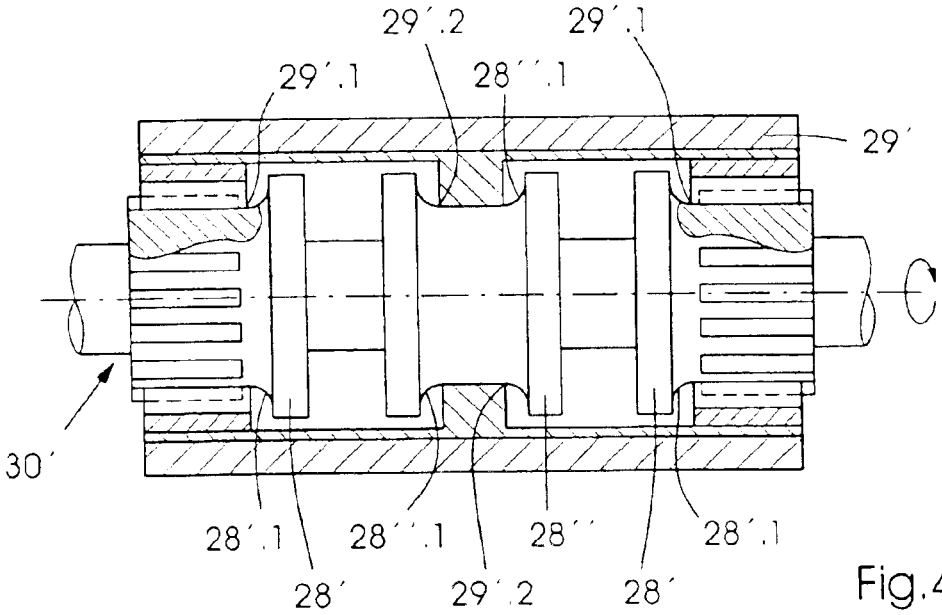
FIG. 4 is a view like that of FIG. 3 of a third embodiment of the belt guide which is formed with rotationally symmetrical stop surfaces.

Rather, FIG. 4 shows different ways of assigning stop surfaces and edges of a belt which exhibit the same action as in the development according to FIG. 3. One of the different constructions is based upon a belt 29' which, corresponding with the belt 29 in FIG. 3, has a ridge in the edge region thereof which is provided with an inner gearing. However, deviating from the development according to FIG. 3, a stop surface 28'.1 of a stop 28' is assigned to the edges 29'.1 of the ridges which face towards one another.

Alternatively to the assignments of edges and stops which have been described thus far, or also in addition thereto, in another development, a ridge is provided at the belt 29' at the inner surface thereof, which extends in the longitudinal direction of the belt and serves exclusively for guiding it. A stop surface 28".1 of a stop 28" is respectively assigned to the protruding edges 29'.2 of the ridge which face one another.

In the developments that have been described thus far, the stops 28, 28' and 28", respectively, are disposed on a suitable roller 30 or 30', respectively, for driving or guiding the belt 29 or 29', respectively. However, this is not mandatory.

Figure 5:
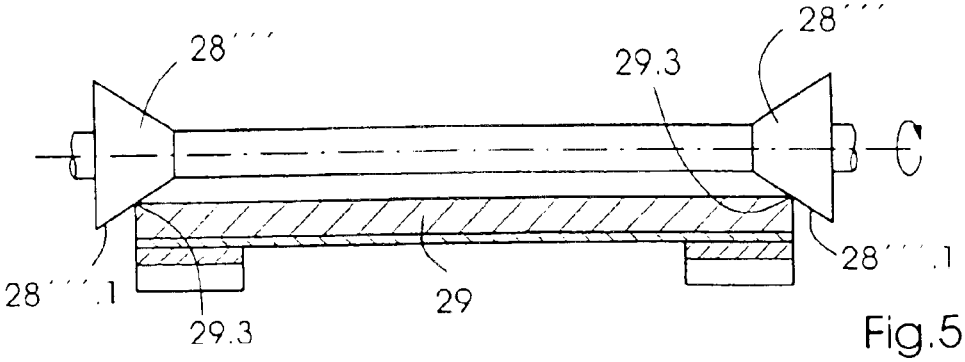
FIG. 5 is a view similar to those of FIGS. 3 and 4 of another embodiment of the belt guide having rotationally symmetrical stop surfaces.

FIG. 5 shows an example of a different development. Here, a rotationally symmetrical stop surface 28".1, which is formed at a stop 28'", is assigned to a strand of the belt 29 at a respective outer edge 29.3 thereof and is in rolling contact with the belt 29.

In another development, which is not illustrated here, corresponding stop surfaces are formed on an idler pulley, which rests against the outer surface of a strand of the belt 29.

Another field of use of the belt drive described herein is exemplarily represented by a transport device which transfers a flat printing material to a machine which prints images thereon. In this regard, the transport device is assigned to a first processing station of such a machine.

Figure 6:
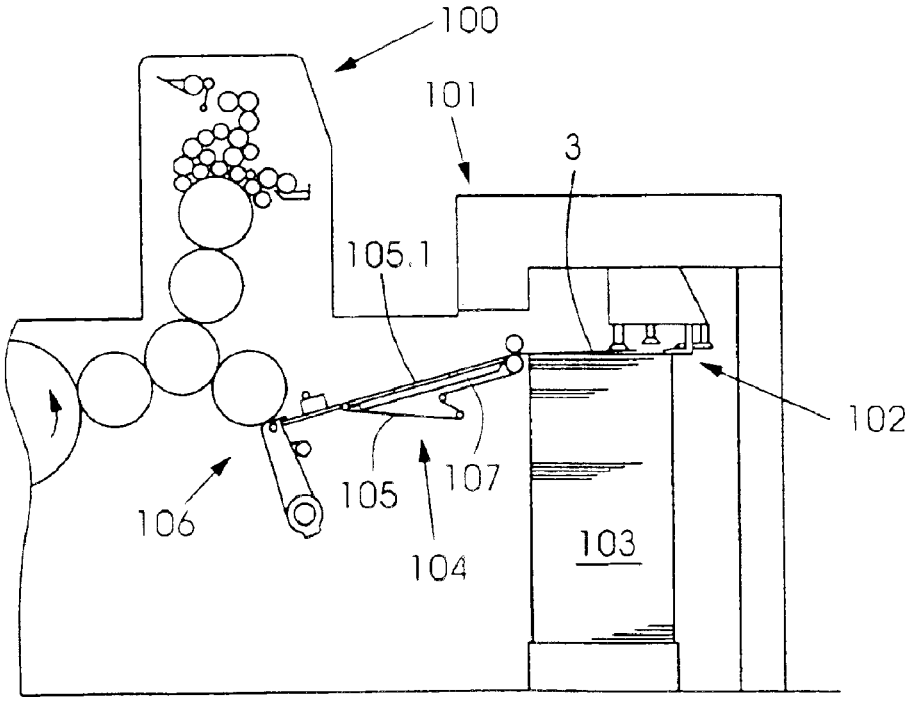
FIG. 6 is a rough diagrammatic fragmentary side elevational view of a sheet-processing rotary printing machine which is equipped with belt drives, the illustrated section of the printing machine including a sheet feeder.

In an example shown in FIG. 6, the machine is a rotary printing machine operating by the offset method, which processes the sheet 3, a rough diagrammatic view being provided of a first printing unit 100 and a transport unit in the form of a feeder 101 which feeds the sheet 3 to the printing unit 100. The feeder 101 device 101 removes individual sheets 3 from a pile 103 of sheets 3 by a separating or singling device 102 and transfers them to a transport strand 105.1 of a belt drive 104 having a belt 105, which is preferably constructed in accordance with one of the FIGS. 2 to 4. The belt 105 transports the sheets 3 to a transfer device 106. In the example of FIG. 6, the transfer device 106 includes a pre-gripper which oscillates back and forth between a feeding table and a feeding drum in accordance with the sheet processing cycle, and grips a gripper margin of the sheets 3 which have been aligned on the feeding table, and which transfers the sheets to a gripper system that is provided on a feeding drum.

In the application of the belt drive 24, 104 that have been described thus far, the described suction table 26 or a suction table 107, respectively, is allocated to the inside of the brake strand 25.1 or the transport strand 105.1, respectively, with the suction action of the table penetrating openings of the belt 25, 29, 29', 105 and generating a respectively necessary holding force between the sheet 3 and the brake strand 25.1 or the transport strand 105.1, respectively.

We claim:

1. A belt drive for a machine for printing images on a flat printing material, comprising:

a belt for revolving during operation, said belt defining a longitudinal direction and a transverse direction, said belt having two protruding edges oriented in the longitudinal direction of said belt and being opposite one another in the transverse direction of said belt, and said belt having a brake strand contacting the flat printing material for braking the flat printing material; and a belt guide having stops with shaped surfaces acting on said two protruding edges of said belt;

said shaped surfaces being concavely curved surfaces.

2. The belt drive according to claim 1, wherein: said shaped surfaces are rotationally symmetrical stop surfaces in rolling contact with said edges.

3. A machine for printing images on flat printing material, comprising a belt drive including:

a belt for revolving during operation, said belt defining a longitudinal direction and a transverse direction, said belt having two protruding edges oriented in the longitudinal direction of said belt and being opposite one another in the transverse direction of said belt, and said belt having a brake strand contacting the flat printing material for braking the flat printing material; and a belt guide having stops with shaped surfaces acting on said two protruding edges of said belt;

said shaped surfaces being concavely curved surfaces.

* * * * *